US008130164B2

(12) United States Patent
Semonov et al.

(10) Patent No.: US 8,130,164 B2
(45) Date of Patent: Mar. 6, 2012

(54) BROADBAND COPLANAR ANTENNA ELEMENT

(75) Inventors: Kostyantyn Semonov, Irvine, CA (US); Alexander Rabinovich, Cypress, CA (US); Bill Vassilakis, Orange, CA (US)

(73) Assignee: Powerwave Technologies, Inc., Santa Ana, CA (US)

( * ) Notice: Subject to any disclaimer, the term of this patent is extended or adjusted under 35 U.S.C. 154(b) by 669 days.

(21) Appl. No.: 12/212,533

(22) Filed: Sep. 17, 2008

(65) Prior Publication Data

US 2009/0079653 A1 Mar. 26, 2009

Related U.S. Application Data

(60) Provisional application No. 60/994,557, filed on Sep. 20, 2007.

(51) Int. Cl.
*H01Q 9/28* (2006.01)

(52) U.S. Cl. ..... 343/795; 343/700 MS

(58) Field of Classification Search ..... 343/700 MS, 343/795, 815, 833
See application file for complete search history.

(56) References Cited

U.S. PATENT DOCUMENTS 4,812,855 A * 3/1989 Coe et al. ..... 343/818
6,067,053 A 5/2000 Runyon et al.
6,670,923 B1 12/2003 Kadambi et al.
7,215,285 B2 * 5/2007 Song et al. ..... 343/700 MS
2003/0218571 A1 * 11/2003 Yoon et al. ..... 343/700 MS
2004/0125031 A1 7/2004 Jo et al.
2006/0290573 A1 12/2006 Puente Baliarda et al.
2009/0096698 A1 * 4/2009 Semonov et al. ..... 343/795

OTHER PUBLICATIONS

PCT International Search Report and Written Opinion of the International Search Authority for Application No. PCT/US08/10851 dated Nov. 25, 2008.

* cited by examiner

*Primary Examiner* — Tan Ho

(74) *Attorney, Agent, or Firm* — OC Patent Law Group

(57) ABSTRACT

A broadband antenna element configuration having a radiation pattern useful in an antenna array containing a plurality of driven radiating elements that are spatially arranged is disclosed. The antenna element is coplanarly disposed on a suitable planar substrate of dielectric material. The antenna element utilizes a pair of balanced dipole arm elements symmetrically disposed about the centerline of a balanced feed network. Balanced feed network elements are disposed in a broadside symmetrical configuration on first plane and second plane on each side of the aforementioned dielectric. Disposed proximate to each dipole arm element are partially overlapping, parallel planar, frequency bandwidth expanding microstrip lines. The combination of dipole arms and parasitically coupled microstrip lines provides a broad bandwidth radiating element suitable for use in antenna arrays.

17 Claims, 6 Drawing Sheets

BROADBAND COPLANAR ANTENNA ELEMENT

RELATED APPLICATION INFORMATION

The present application claims priority under 35 USC section 119(e) to U.S. provisional patent application Ser. No. 60/994,557 filed Sep. 20, 2007, the disclosure of which is incorporated herein by reference in its entirety.

BACKGROUND OF THE INVENTION

1. Field of the Invention

The present invention relates in general to radio communication systems and components. More particularly the invention is directed to antenna elements and antenna arrays for radio communication systems.

2. Description of the Prior Art and Related Background Information

Modern wireless antenna implementations generally include a plurality of radiating elements that may be arranged to provide a desired radiated (and received) signal beamwidth and azimuth scan angle. For a wide beamwidth antenna it is desirable to achieve a near uniform beamwidth that exhibits a minimum variation over the desired azimuthal as degrees of coverage. Such antennas provide equal signal coverage over a wide area which is useful in certain wireless applications. In modern applications, it is also necessary to provide a consistent beamwidth over a wide frequency bandwidth.

Consequently, there is a need to provide an improved broadband antenna structure with desired beamwidth. Furthermore, it is desirable to provide such an antenna in a relatively compact and low cost construction suitable for use in antenna arrays.

SUMMARY OF THE INVENTION

In a first aspect the present invention provides an antenna radiating structure comprising a generally planar dielectric support structure, a first generally planar radiating element configured on one side of the dielectric support structure, a second generally planar radiating element configured on an opposite side of the dielectric support structure and configured in a generally parallel plane with the first generally planar radiating element, and means for expanding the bandwidth of the antenna radiating structure configured on the dielectric support structure and spaced apart from the radiating elements.

In a preferred embodiment of the antenna radiating structure the means for expanding the bandwidth of the antenna radiating structure comprises first and second conductive elements formed on opposite sides of the dielectric support structure. The first and second planar radiating elements preferably comprise elongated conductive strips and the first and second conductive elements preferably comprise planar strips parallel to and spaced apart from the elongated conductive strips of the first and second planar radiating elements. The first and second conductive elements preferably have a partial overlap and the amount of overlap controls the amount of beamwidth expansion. The strips comprising the first and second conductive elements are preferably shorter than the elongated conductive strips of the first and second planar radiating elements. The strips comprising the first and second conductive elements are preferably wider than the elongated conductive strips of the first and second planar radiating elements. In one example application the amount of overlap is between 240 and 270 mils. For example, in this application the antenna radiating structure operational radio frequency (RF) may be approximately 3.15 GHz to 3.80 GHz. In such example the planar strips are preferably spaced apart from the elongated conductive strips of said first and second planar radiating elements by about 180 to 210 mils.

In another aspect the present invention provides an antenna radiating structure, comprising a planar dielectric substrate, first and second ⌈-shaped dipole radiating elements formed on opposite sides of the dielectric substrate, first and second bandwidth enhancement elements formed on opposite sides of the dielectric substrate proximate to respective dipole radiating elements, and a balanced RF feed network feeding the dipole radiating elements.

In a preferred embodiment of the antenna radiating structure the shape of the dipole radiating elements is mirror symmetric and the overall structure, including the feed network, has a T-shape. The dipole radiating elements preferably comprise microstrip dipole arms on respective sides of the dielectric substrate, and the bandwidth enhancement elements preferably comprise planar microstrips which are parallel to each dipole arm and at least partially overlapping each other. When an x-y coordinate system is defined so that the origin is set at the bottom end of the T shaped structure of the antenna element, the y-axis is the symmetric vertical line of the T shape, and the x-axis is parallel to the top of the T shape and perpendicular to the y-axis, the balanced feed network center line is in the longitudinal direction of the y-axis before transitioning to each planar dipole arm which extend parallel to the x-axis along a centerline axis $CL_1$, but in opposite directions relative to the balanced feed network center line. The bandwidth enhancement microstrips preferably extend parallel to the x-axis along a centerline axis $CL_2$ separated by a distance s1 from centerline axis $CL_1$. The microstrip dipole arms have a width w1 and the bandwidth enhancement microstrips preferably have a defined width w2 greater than w1. The bandwidth enhancement microstrips preferably share broadside overlap dimension o1 over each other and the amount of overlap provides control over useful frequency bandwidth. The two dipole arms are preferably identical in width w1 and length L1. The bandwidth enhancement microstrips preferably are identical in width w2 and length L2.

In another aspect the present invention provides an antenna array, comprising a ground plane and a plurality of radiating structures configured on the ground plane, each comprising a planar dielectric substrate extending perpendicularly to said ground plane, a balanced RF feed network formed on the substrate, a pair of balanced dipole radiating elements including a pair of dipole arm elements symmetrically disposed about the centerline of said balanced feed network, and partially overlapping, planar, frequency bandwidth expanding microstrip lines disposed proximate to the dipole arm elements.

In a preferred embodiment of the antenna array the balanced RF feed network comprises balanced feed network elements disposed in a symmetrical configuration on a first plane and second plane on each side of the dielectric substrate.

Further features and advantages of the present invention will be appreciated from the following detailed description of the invention.

DETAILED DESCRIPTION OF THE INVENTION

Figure 1:
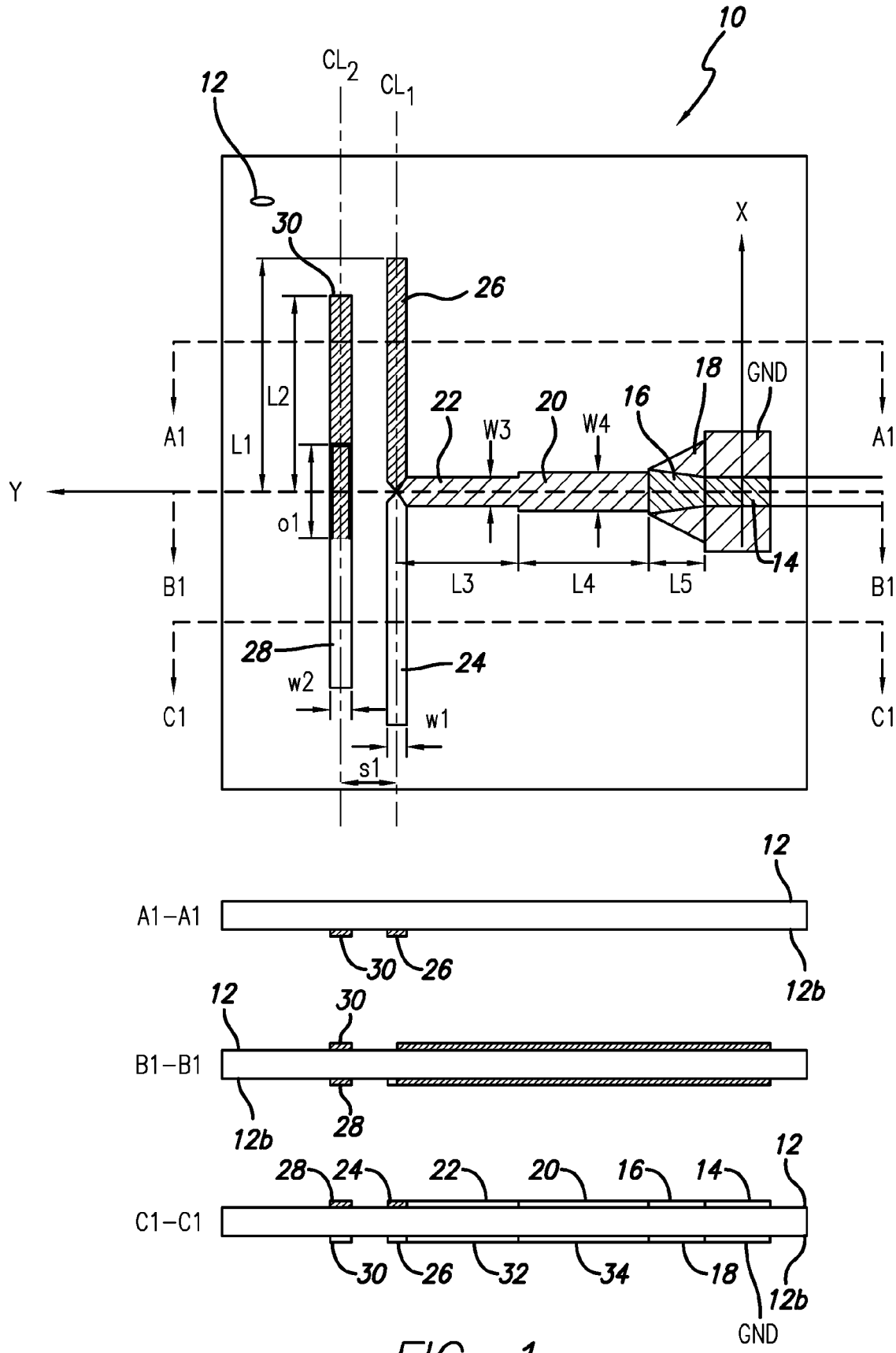
FIG. 1 is a top view and selected planar cross-sections of an antenna element in accordance with a preferred embodiment of the invention.

Reference will be made to the accompanying drawings, which assist in illustrating the various pertinent features of the present invention. Some of the components represented in the drawings are not necessarily to scale, emphasis instead being placed upon clearly illustrating the principles of the present invention. In certain instances herein chosen for illustrating the invention, certain terminology is used which will be recognized as being employed for convenience and having no limiting significance. For example, the terms "horizontal", "vertical", "upper", "lower", "bottom" and "top" refer to the illustrated embodiment in its normal position of use.

One object of the present invention is to provide a dielectric based coplanar antenna element which has broad frequency bandwidth, is easy to fabricate using conventional PCB processes, and has a low profile. In carrying out these and other objectives, features, and advantages of the present invention, a broad bandwidth antenna element is provided for use in a wireless network system.

FIG. 1 shows a top view of a coplanar antenna element, 10, according to an exemplary implementation, which utilizes a substantially planar dielectric material 12. Radiating element 10 may be of any suitable construction preferably employing a method which prints or attaches metal conductors directly on top and bottom 12*b* sides of a dielectric substrate 12 such as a PCB (printed circuit board). The square dielectric plane 12 is dimensioned to fit all necessary conductors in a manner which is not only compact but which provides radiation pattern, frequency response and bandwidth over the desired frequency. In one embodiment the desired radio frequency (RF) may be approximately 3.15 GHz to 3.80 GHz and the antenna element is constructed utilizing a commercially available PCB material, such as manufactured by Taconic, specifically Taconic RF-35, $\in_r$=3.5 and thickness=30 mils. Alternative dielectric substrates (PCB material) 12 are possible provided that properties of such substrate are chosen in a manner to be compatible with commonly available PCB processes. Alternatively metal conductor attachment to alternative dielectric substrates can be achieved through various means known to those skilled in the art.

As shown, antenna element 10 is provided with an upper dielectric side RF input-output port 14. The input RF signal is further coupled over a balun structure comprising top coplanar microstrip element 16 and bottom microstrip element 18. A balun is an electromagnetic structure for interfacing a balanced impedance device or circuit, such as an antenna, with an unbalanced impedance, such as a coaxial cable or microstrip line. In its common use a balanced signal comprises a pair of symmetrical signals, which are equal in magnitude and opposite in phase (180 degrees). In contrast, an unbalanced impedance may be characterized by a single conductor for supporting the propagation of unbalanced (i.e., asymmetrical) signals relative to a second conductor (i.e., ground). Numerous balun structures are known to those skilled in the art for converting unbalanced to balanced signals and vice versa.

Thereafter, balanced RF signals are coupled into a multi section impedance transformer. A multi-section impedance transformer is employed to match balun impedance to a dipole feed point impedance without reducing useful frequency bandwidth. In this manner a first transformer section is comprised of a top microstrip line 20 and a bottom microstrip line 34. The first transformer section has a length L4 which is optimized along with other dimensions for the target operating frequency range. Output of the first transformer section is coupled to a second transformer section which is further comprised of a top microstrip line 22 and a bottom microstrip line 32. Output of the second transformer top microstrip line 22 is coupled to the top side dipole 24 element and bottom microstrip line 32 is coupled to the bottom dipole 26 element. The second transformer section has a length L3 which is also optimized along with other dimensions for the target operating frequency range.

Radiating element 10 is comprised of top sided dipole element 24 having its longitudinal center axis $CL_1$ perpendicular to the y axis and traversing away from the y-axis in a negative x dimension direction, and bottom dipole element 26 having its longitudinal center axis $CL_1$ perpendicular to the y axis and traversing away from the y-axis in a positive x dimension direction. The two dipole arms 24, 26 are symmetrical about the y-axis, and disposed on the opposite sides of the planar dielectric 12. The two dipole arms 24, 26 are preferably identical in width w1 and length L1. Alternative implementations using an asymmetric dipole structure can be devised, but such configuration may introduce unbalancing effects on a balanced feed network and thus may not be preferred.

In further reference to FIG. 1, disposed proximate to dipole arms 24, 26 (on a corresponding side of dielectric substrate 12, 12*b*) are bandwidth expanding microstrip elements 28, 30 separated by distance s1 between corresponding centerline axis $CL_1$ and $CL_2$. The bandwidth expanding microstrip elements 28, 30 have a defined width w2, and longitudinal center axis aligned with the $CL_2$ axis which is also perpendicular to the y axis. Microstrip elements 28, 30 share broadside overlap dimension o1 over each other and the amount of overlap provides control means over useful frequency bandwidth. It will be apparent to those skilled in the art that antenna radiating structure 10 may include an additional number of bandwidth expanding microstrip element pairs (i.e., one or more) implemented in accordance with the present invention to augment the radiation pattern as desired.

Figure 2:
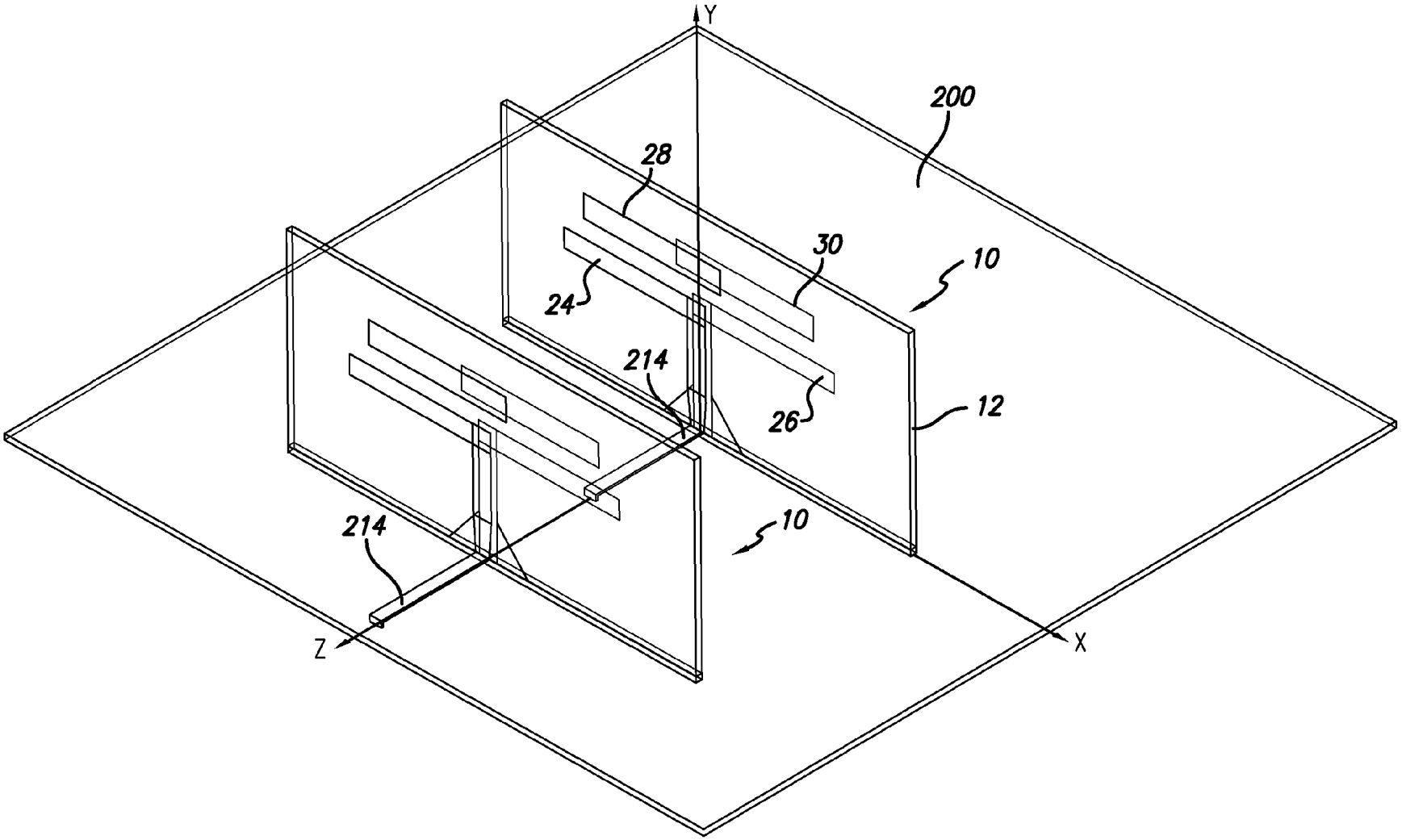
FIG. 2 is an isometric view of an antenna element in accordance with a preferred embodiment of the invention mounted on a ground plane.
Figure 3:
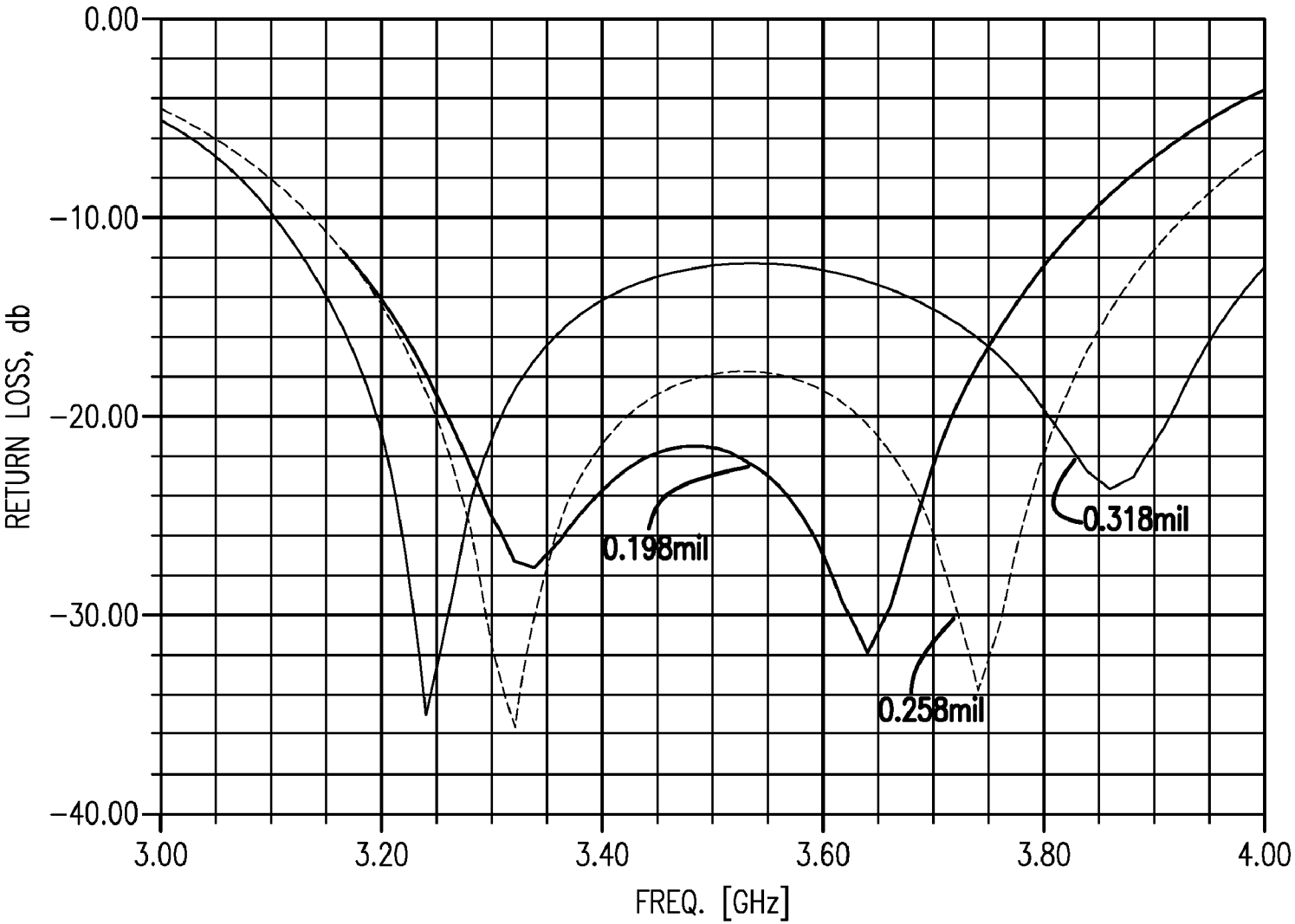
FIG. 3 is a graph showing simulated input return loss over frequency for various overlap (o1) dimensions.

Referring to FIG. 2, an embodiment of the invention with plural antenna radiating structures 10 mounted on a ground plane 200 to form an antenna array is illustrated. Each of the structures 10 correspond to that of FIG. 1 and need not be further described. The RF input/output ports of antenna radiating structures 10 are coupled to feed lines 214 which may be microstrip lines formed on a dielectric and coupled to the RF sources. Although two antenna radiating structures 10 are shown it will be appreciated that additional antenna radiating structures 10 can be mounted on ground plane 200 to form the antenna array. Further it will be appreciated by those skilled in the art that antenna radiating structures 10 can be arranged in various configurations, including plural rows and columns. Therefore, although two structures 10 are shown for ease of illustration, such embodiments with additional numbers and configurations of antenna radiating structures 10 are equally implied herein.

Figure 4:
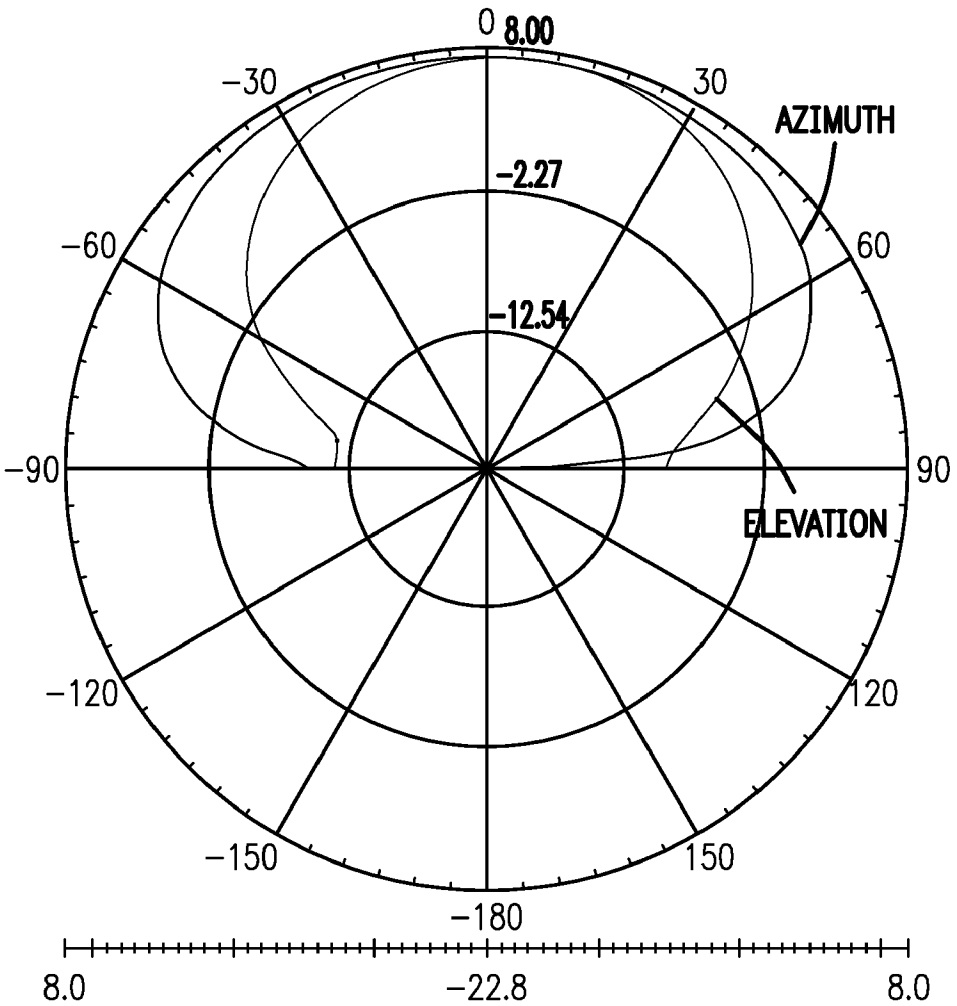
FIG. 4 is a graph showing simulated azimuth and elevation radiation plots of an exemplary antenna element in accordance with the invention.
Figure 5:
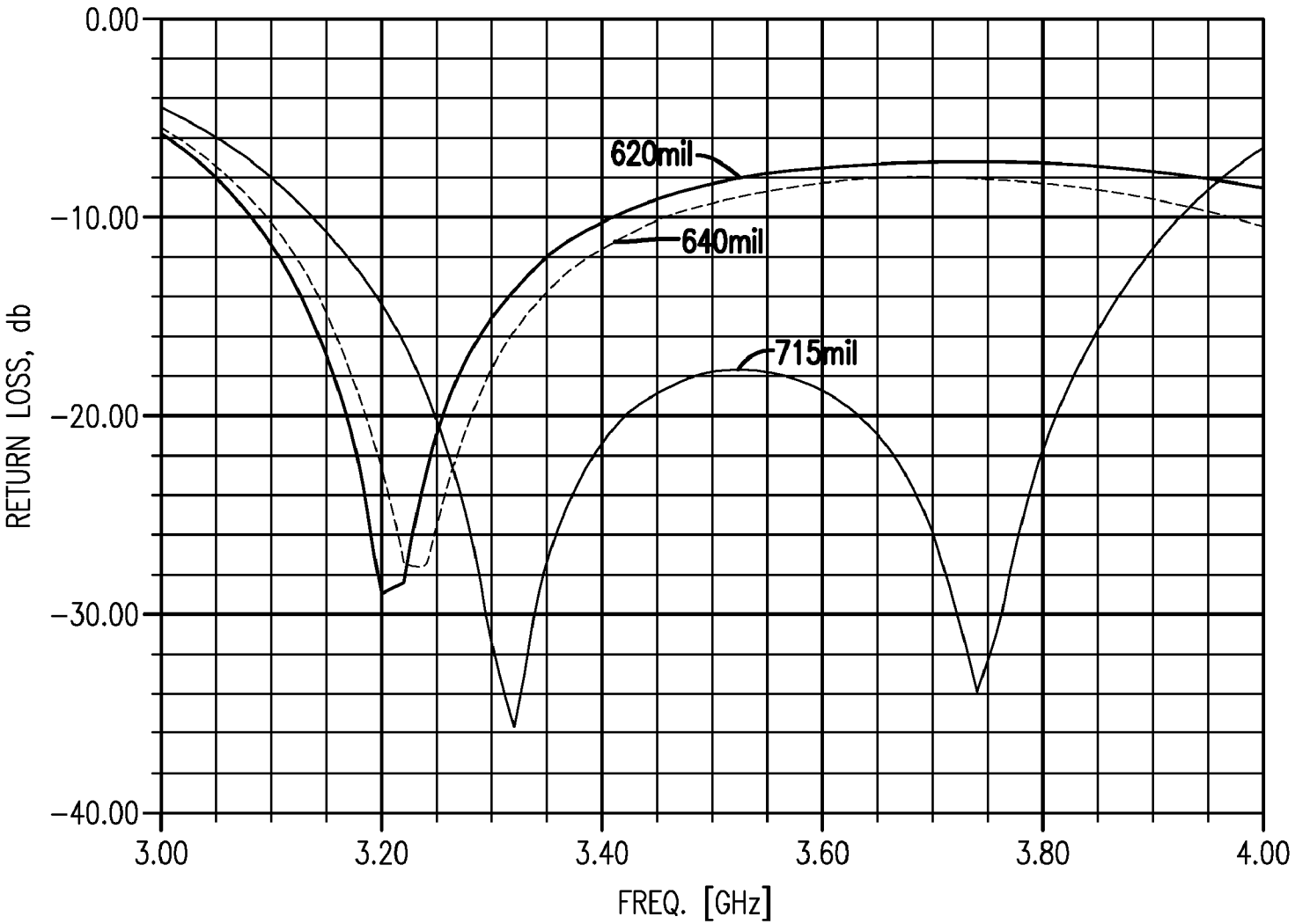
FIG. 5 is a graph showing simulated return loss vs. bandwidth for various lengths (L2) of bandwidth expanding microstrip lines.
Figure 6:
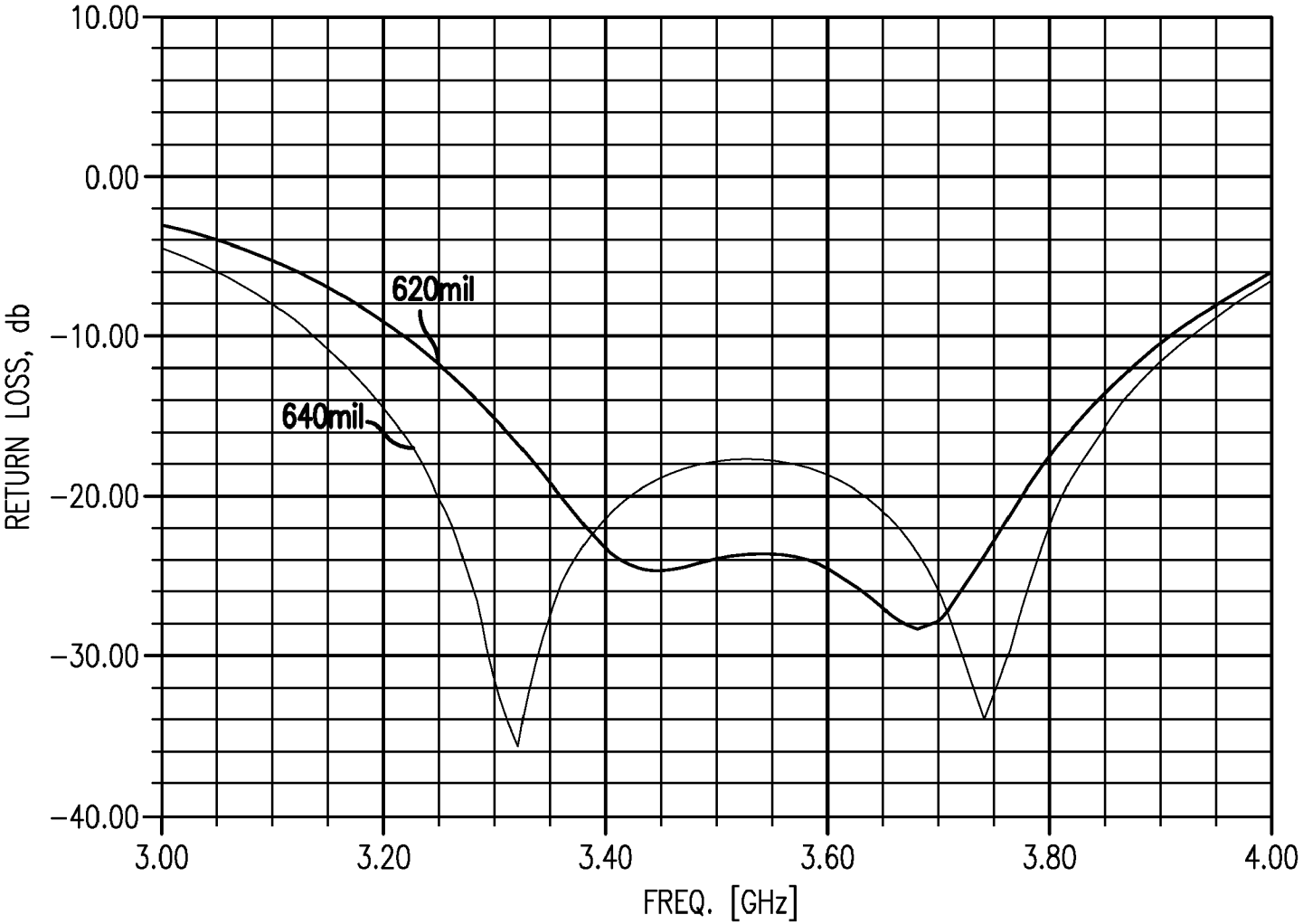
FIG. 6 is a graph showing simulated return loss vs. bandwidth for various lengths (L1) of dipole arms.

Referring to FIGS. 3-6 simulated antenna performance including the effects of variation of the above noted parameters on antenna performance are illustrated. FIG. 4 is a graph showing simulated azimuth and elevation radiation plots of an exemplary antenna element in accordance with the invention. The simulated bandwidth variation vs. overlap distance o1 of the microstrip lines 28, 30 is presented in FIG. 3. FIG. 5 is a graph showing simulated return loss vs. bandwidth for various lengths (L2) of bandwidth expanding microstrip lines 28, 30. FIG. 6 is a graph showing simulated return loss vs. bandwidth for various lengths (L1) of dipole arms 24, 26.

Preferred dimensions for a 3.15 GHz to 3.80 GHz embodiment with 50 impedance source 14 are shown in the following table.

TABLE 1

| Reference | Min (mils) | Max (mils) | Typical (mils) |
|---|---|---|---|
| L1 | 670 | 700 | 684 |
| L2 | 560 | 590 | 576 |
| L3 | 481 | 520 | 496 |
| W3 | | | 62.8 Ω |
| L4 | 475 | 510 | 491 |
| W4 | | | 54.8 Ω |
| L5 | 180 | 310 | 195 |
| o1 | 240 | 270 | 258 |
| w1 | 80 | 95 | 88 |
| w2 | 100 | 130 | 112 |
| s1 | 180 | 210 | 192 |

It will be appreciated that antennas operating at alternative frequency ranges may employ the teachings of the present invention and the above parameters may be varied for such applications.

The present invention has been described in a preferred embodiment but the description is not intended to limit the invention to the form disclosed herein. Accordingly, variants and modifications consistent with the following teachings, and skill and knowledge of the relevant art, are within the scope of the present invention. The embodiments described herein are further intended to explain modes known for practicing the invention disclosed herewith and to enable others skilled in the art to utilize the invention in equivalent, or alternative embodiments and with various modifications considered necessary by the particular application(s) or use(s) of the present invention.

What is claimed is:

1. An antenna radiating structure, comprising:

a generally planar dielectric support structure;

a first generally planar radiating element configured on one side of said dielectric support structure;

a second generally planar radiating element configured on an opposite side of said dielectric support structure and configured in a generally parallel plane with said first generally planar radiating element;

a first conductive element configured on said one side of said dielectric support structure and spaced apart from said first radiating element; and a second conductive element configured on said opposite side of said dielectric support structure and spaced apart from said second radiating element;

wherein said first and second conductive elements have a partial overlap and wherein the amount of overlap controls the amount of beamwidth expansion.

2. An antenna radiating structure as set out in claim 1, wherein said first and second planar radiating elements comprise elongated conductive strips and wherein said first and second conductive elements comprise planar strips parallel to and spaced apart from the elongated conductive strips of said first and second planar radiating elements.

3. An antenna radiating structure as set out in claim 2, wherein the strips comprising said first and second conductive elements are shorter than the elongated conductive strips of said first and second planar radiating elements.

4. An antenna radiating structure as set out in claim 2, wherein the strips comprising said first and second conductive elements are wider than the elongated conductive strips of said first and second planar radiating elements.

5. An antenna radiating structure as set out in claim 4, wherein the amount of overlap is between 240 and 270 mils.

6. An antenna radiating structure as set out in claim 5, wherein the antenna radiating structure operational radio frequency (RF) is approximately 3.15 GHz to 3.80 GHz.

7. An antenna radiating structure as set out in claim 2, wherein said planar strips are spaced apart from the elongated conductive strips of said first and second planar radiating elements by about 180 to 210 mils.

8. An antenna radiating structure, comprising:

a planar dielectric substrate;

first and second r-shaped dipole radiating elements formed on opposite sides of the dielectric substrate;

first and second bandwidth enhancement elements formed on opposite sides of the dielectric substrate proximate to respective dipole radiating elements wherein said bandwidth enhancement elements share broadside overlap dimension o1 over each other and the amount of overlap provides control over useful frequency bandwidth; and a balanced RF feed network feeding said dipole radiating elements.

9. An antenna radiating structure as set out in claim 8, wherein the shape of the dipole radiating elements is mirror symmetric and the overall structure, including the feed network, has a T-shape.

10. An antenna radiating structure as set out in claim 9, wherein said dipole radiating elements comprise microstrip dipole arms on respective sides of the dielectric substrate, and wherein said bandwidth enhancement elements comprise planar microstrips which are parallel to each dipole arm and at least partially overlapping each other.

11. An antenna radiating structure as set out in claim 10, wherein when an x-y coordinate system is defined so that the origin is set at the bottom end of said T shaped structure of the antenna element, the y-axis is the symmetric vertical line of said T shape, and the x-axis is parallel to the top of said T shape and perpendicular to the y-axis, the balanced feed network center line is in the longitudinal direction of the y-axis before transitioning to each planar dipole arm which extend parallel to the x-axis along a centerline axis $CL_1$, but in opposite directions relative to the balanced feed network center line.

12. An antenna radiating structure as set out in claim 11, wherein said bandwidth enhancement microstrips extend parallel to the x-axis along a centerline axis $CL_2$ separated by a distance s1 from centerline axis $CL_1$.

13. An antenna radiating structure as set out in claim 11, wherein said microstrip dipole arms have a width w1 and said bandwidth enhancement microstrips have a defined width w2 greater than w1.

14. An antenna radiating structure as set out in claim 11, wherein the two dipole arms are identical in width w1 and length L1.

15. An antenna radiating structure as set out in claim 11, wherein said bandwidth enhancement microstrips are identical in width w2 and length L2.

16. An antenna array, comprising:

a ground plane; and a plurality of radiating structures configured on the ground plane, each comprising a planar dielectric substrate extending perpendicularly to said ground plane, a balanced RF feed network formed on the substrate, a pair of balanced dipole radiating elements including a pair of dipole arm elements symmetrically disposed about the centerline of said balanced feed network, and partially overlapping, planar, frequency bandwidth expanding microstrip lines disposed proximate to the dipole arm elements.

17. An antenna array as set out in claim 16, wherein said balanced RF feed network comprises balanced feed network elements disposed in a symmetrical configuration on a first plane and second plane on each side of said dielectric substrate.

* * * * *